United States Patent [19]

Matsukura et al.

[11] Patent Number: 4,636,101

[45] Date of Patent: Jan. 13, 1987

[54] LOW-NOISE TYPE IMPACT PRINTER

[75] Inventors: Hiroyuki Matsukura; Fumio Yamauchi, both of Tokyo, Japan

[73] Assignee: NEC Corporation, Tokyo, Japan

[21] Appl. No.: 718,302

[22] Filed: Apr. 1, 1985

[30] Foreign Application Priority Data

Mar. 30, 1984 [JP] Japan ..... 59-62410

[51] Int. Cl.[4] ..... B41J 29/10; B41J 29/08

[52] U.S. Cl. ..... 400/690; 181/201

[58] Field of Search ..... 400/690; 181/201

[56] References Cited

U.S. PATENT DOCUMENTS 1,234,086 7/1917 Powers ..... 400/690
1,542,924 6/1925 Waldheim ..... 400/690
2,702,244 3/1937 Courson ..... 400/690
3,308,919 3/1967 Cunningham ..... 400/690
4,135,830 1/1979 Hishida et al. ..... 400/690

OTHER PUBLICATIONS

*IBM Technical Disclosure,* vol. 25, No. 11A, Apr. '83, "Machine Covers with Integral Internal Surface Absorption", Gaunt and Lanham.

*Primary Examiner*—Edgar S. Burr
*Assistant Examiner*—Tonya Eckstine
*Attorney, Agent, or Firm*—Sughrue, Mion, Zinn, Macpeak & Seas

[57] ABSTRACT

The noise level of an impact printer is reduced by at least 5 dB by providing a resonant absorption chamber between the printer frame and the cover which is designed so as to have a resonance frequency corresponding to the fundamental frequency of the printer noise.

1 Claim, 5 Drawing Figures

LOW-NOISE TYPE IMPACT PRINTER

BACKGROUND OF THE INVENTION

This invention relates to an impact printer, and more particularly to a low-noise type impact printer.

In a conventional impact printer, a reduction in the noise generated by the printing mechanism has been achieved by shielding the printing mechanism using cover means and by employing noise absorbing material such as sponge in the cover means. However, because of size and restraints on such cost impact printers, an absorbing material having a thickness sufficient to fully absorb the noise can not be provided, whereby a sufficient noise absorbing effect can not be expected. The printer noise and the sound pressure of the noise leaking from interstices of the cover means are accordingly to heightened, to thereby deteriorate the noise reducing effect.

SUMMARY OF THE INVENTION

It is, therefore, an object of this invention to provide a low-noise type impact printer having a simplified absorbing mechanism.

According to this invention, there is provided a low-noise impact printer comprising: an impact printing mechanism; a frame member for supporting said impact printing mechanism; cover means for covering said impact printing mechanism and said frame member; and means for absorbing noise generated by said impact printing mechanism, said absorbing means having a resonant frequency corresponding to a frequency of said noise.

BRIEF DESCRIPTION OF THE DRAWINGS

Other features and advantages of this invention will be apparent from the following detailed description of a preferred embodiment of this invention taken in conjunction with the accompanying drawings, wherein.

DETAILED DESCRIPTION OF THE PREFERRED EMBODIMENTS

Figure 1:
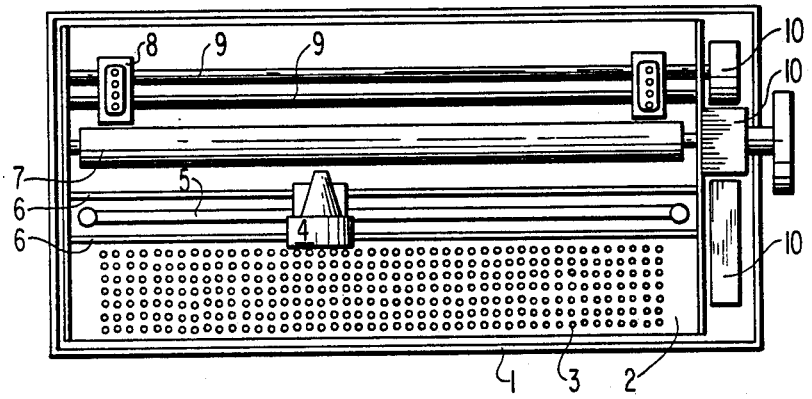
FIG. 1 is a schematic plan view of an embodiment of this invention.
Figure 2:
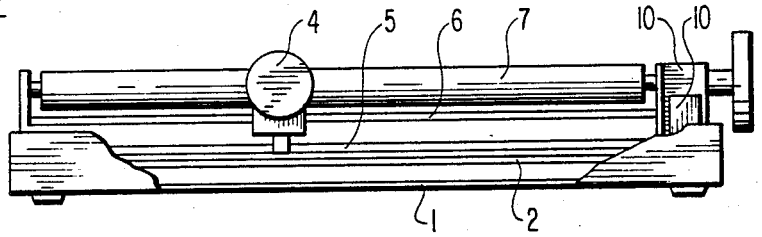
FIG. 2 is a side view of the embodiment shown in FIG. 1.

Referring to FIGS. 1 and 2, a dot-impact type serial printer according to an embodiment of this invention comprises an impact printing mechanism composed of a printing head 4 and a platen 7, a frame 2, an upper cover (not shown) and a lower cover 1, and control units 10. A noise generated by the printing mechanism is reflected by a head-moving belt 5, head-moving guide bars 6, paper feeding tractors 8, tractor supporting bars 9 and the control units 10, whereby the sound field within the printer is heightened.

Figure 3:
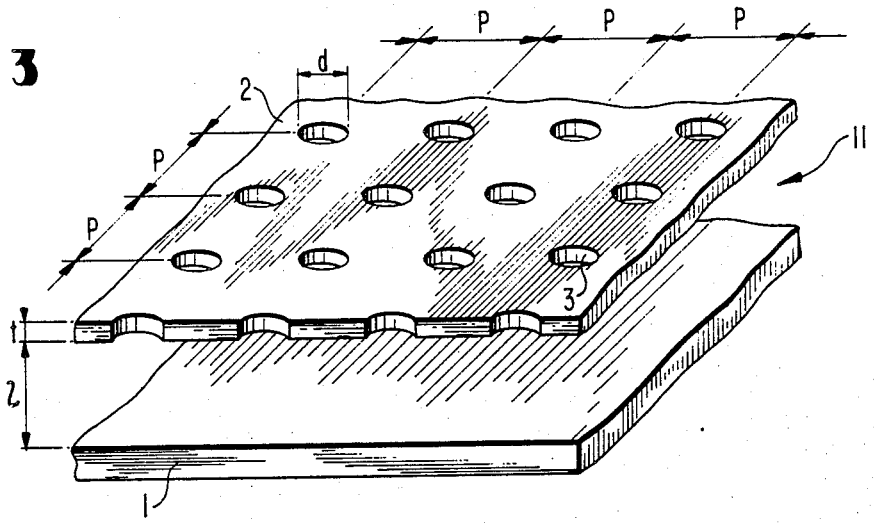
FIG. 3 is a perspective view of a noise absorbing mechanism used in the embodiment shown in FIG. 1.

In order to absorb the sound field and to reduce the noise, there is provided a resonance noise-absorbing mechanism constituted of a space 11 between the lower cover 1 and the frame 2. The frame 2 has a great number of through holes 3 arranged in matrix form as shown in FIGS. 1 and 3. The noise generated by the impact printing mechanism is led to the resonance noise-absorbing space 11. The resonance frequency f can be represented by $$f = Cd/4P \times \sqrt{1/\pi(t + 0.8d)l}$$

where d stands for the diameter of a hole 3; P, for the pitch of the holes 3; t, for the depth of the hole 3 i.e. the thickness of the frame 2; 1, for the distance between the upper surface of the cover 1 and the lower surface of the frame 2; and C, for the sound velocity (340 m/sec at normal temperature).

In this invention, the noise can be be markedly reduced by making the resonance frequency f equal to the fundamental frequency of the noise. Since the fundamental frequency of the noise generated by the impact printer according to the embodiment is 1 KHz, the resonance frequency f is selected as 1 KHz and the respective parameters are defined as follows:

$$d = 4.0 \text{ mm} = 4.0 \times 10^{-3} \text{m}$$

$$t = 1.6 \text{ mm} = 1.6 \times 10^{-3} \text{m}$$

$$P = 20 \text{ mm} = 20 \times 10^{-3} \text{m}$$

$$l = 19 \text{ mm} = 19 \times 10^{-3} \text{m}.$$

Figure 4A:
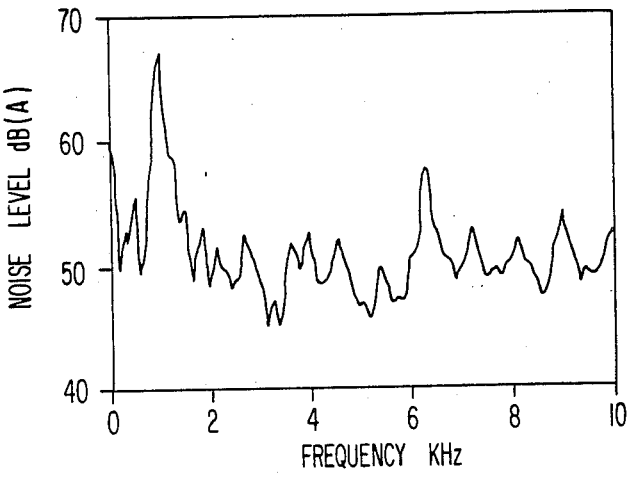
FIGS. 4(A) and 4(B) show noise-frequency vs. noise-level characteristics for a conventional impact printer and the embodiment shown in FIG. 1, respectively.
Figure 4B:
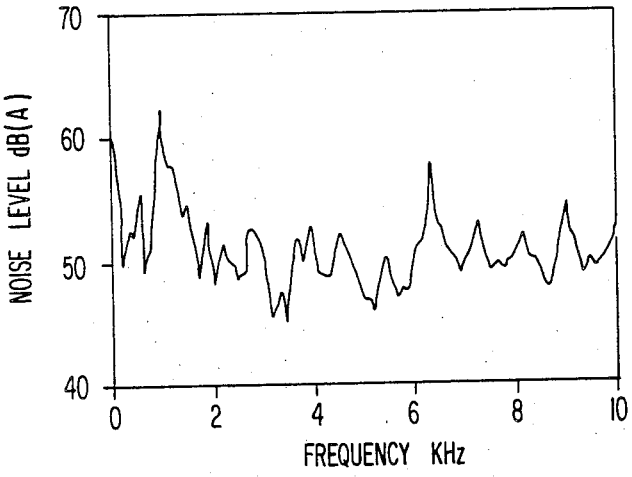

As will be understood from FIGS. 4(A) and 4(B), an impact printer constructed according to this embodiment can be reduced in noise level by about 5 dB.

As described above, the resonance noise-absorbing mechanism of the invention, constituted of the space between the frame and the cover of the printer, resonantly absorbs the noise generated by the impact printing mechanism to thereby reduce noise. Further, since the absorbing space is constituted of parts of the frame and the cover, a small-sized and low-cost impact printer can still be obtained.

What is claimed is:

1. A low noise type impact printer, comprising:

an impact printing mechanism;

a frame member for supporting said impact printing mechanism;

covering means for covering said impact printing mechanism and said frame;

means for absorbing noise generated by said impact printing mechanism;

said absorbing means having a resonant frequency corresponding to a fundamental frequency of said noise;

said absorbing means comprising a space formed between said frame member and said cover means at a location below said printing mechanism;

said frame member being provided with an array of through holes; wherein the size of said through holes, the pitch or spacing between said through holes, the thickness of said frame member, and the distance between said frame member and said cover means are selected such that said space is given a resonant frequency corresponding to said fundamental frequency as defined by the following equation:

$$f = Cd/4P \times \sqrt{1/\pi(t + 0.8d)l}$$

wherein:

d is the diameter of one of said holes;

P indicates the pitch or spacing between said holes;

t indicates the thickness of the frame;

l indicates the distance between the upper surface of the cover member and the lower surface of the frame; and C indicates the speed of sound.

* * * * *